US005119623A

United States Patent [19]

Fetzer et al.

[11] Patent Number: 5,119,623

[45] Date of Patent: Jun. 9, 1992

[54] FALSE-TWISTING NOZZLE FOR PNEUMATIC FALSE-TWIST SPINNING

[75] Inventors: Gerhard Fetzer; Hans Braxmeier, both of Süssen, Fed. Rep. of Germany

[73] Assignee: Fritz and Hans Stahlecker, Fed. Rep. of Germany

[21] Appl. No.: 570,049

[22] Filed: Aug. 20, 1990

[30] Foreign Application Priority Data

Aug. 24, 1989 [DE] Fed. Rep. of Germany ..... 3927910

[51] Int. Cl.[5] ..... D01H 7/92

[52] U.S. Cl. ..... 57/333; 57/332; 57/350

[58] Field of Search ..... 57/332, 333, 344–345, 57/350, 348

[56] References Cited

U.S. PATENT DOCUMENTS

| | | | |
|---|---|---|---|
| 3,445,995 | 5/1969 | Bell et al. | 57/333 X |
| 3,999,363 | 12/1976 | Gross | 57/344 |
| 4,141,121 | 2/1979 | Trifunovic | 57/333 X |
| 4,480,435 | 11/1984 | Anahara et al. | 57/350 X |
| 4,509,321 | 4/1985 | Kasita et al. | 57/328 |
| 4,565,064 | 1/1986 | Iwasaski et al. | 57/328 X |
| 4,807,431 | 2/1989 | Braxmeier | 57/328 X |
| 4,858,420 | 8/1989 | Stahlecker et al. | 57/333 X |
| 4,928,477 | 5/1990 | Kalitzki et al. | 57/416 |
| 4,945,718 | 8/1990 | Stahlecker et al. | 57/328 X |

FOREIGN PATENT DOCUMENTS

| | | |
|---|---|---|
| 3718656 | 12/1986 | Fed. Rep. of Germany . |
| 3732708 | 7/1988 | Fed. Rep. of Germany . |
| 3734566 | 4/1989 | Fed. Rep. of Germany . |

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

In the case of a false-twisting nozzle for pneumatic false-twist spinning having a nozzle body formed of one or several segments, it is provided that, for the reduction of the cross-section of the outlet opening of the blow duct, at least one part of its interior wall is provided with a coating.

23 Claims, 2 Drawing Sheets

FALSE-TWISTING NOZZLE FOR PNEUMATIC FALSE-TWIST SPINNING

BACKGROUND AND SUMMARY OF THE INVENTION

The invention relates to a false-twisting nozzle for pneumatic false-twist spinning having a nozzle body formed of one or several segments which is provided with a yarn duct extending through it, at least one blow duct leading tangentially into the yarn duct.

In the case of false-twisting nozzles, it is to be endeavored that the blow ducts lead into the yarn duct in a tangential manner that is as precise as possible and extend as little as possible toward the center of the yarn duct. As a result, it is to be achieved that a clearly defined air whirl develops which grips the yarn roving formed of a drafted sliver at its outer circumference and sets it into rotations. If the blow jets deviate from the tangential direction and/or exit at a relative large distance from the interior wall of the yarn duct, there is the risk that, as a result, the order of the fibers in the fiber roving will be impaired. It is therefore endeavored to provide a blow-in cross-section that is as small as possible and a blow-in direction which is as precisely tangential as possible. However, up to now, it has been difficult to meet both requirements simultaneously.

It is known from German Patent Document DE-C 37 34 566 to provide blow ducts as bores which are to have a diameter of from 0.2 mm to 0.6 mm. Particularly, if the diameters are to amount to less than 0.4 mm, there is the risk that the bore extends in such a way that the tangential direction cannot be maintained sufficiently reliably.

It is also known from German Patent Documents DE-A 37 32 708, DE-A 37 18 656 to provide the blow ducts between two segments of a nozzle body, in which case slots are worked into one of the segments which are covered by the other segment. In this type of construction, it is also difficult to ensure a precise aligning of the slots if the slot widths are small.

It is an object of the invention to provide a false-twisting nozzle of the initially mentioned type which has one or several blow ducts with a precisely tangential alignment with respect to the yarn duct and with a small dimension from the interior wall of the yarn duct toward the center of the duct.

This object is achieved according to preferred embodiments of the invention in that, for the reduction of the cross-section of the outlet opening at least one part of the interior wall of the blow duct is provided with a coating.

As a result, it is possible to produce the blow duct, by means of cutting, first with a relatively large dimension so that the directional precision can be ensured. Subsequently, the final cross-section will then be determined by means of the coating applied to the interior wall or a part of the interior wall so that, despite the originally larger cross-section, a very small cross-section may be obtained without the result of a loss of directional precision.

In a further development of the invention, it is provided that nickel is used as the coating which is chemically deposited on the interior wall of the blow duct. A nickel layer of this type can be applied with very high precision even in the case of complicated shapes so that the original precision will not be lost.

In a further development of the invention, it is provided that the at least one slot leads into a section of the yarn duct which is also provided with the coating. On the one hand, this results in the advantage that the shape of the mouth areas toward the interior wall of the yarn duct is maintained in the produced shape, while, in addition, the advantage is achieved that a protection against wear can be obtained in this area as a result of the coating, particularly if diamond grains are embedded in the nickel coating.

In a further development of the invention, it is provided that the blow duct or blow ducts are machined in between two abutting segments of the nozzle body and that, for developing a blow duct, one of the segments is provided with a slot which is open in the direction of the other segment, in which case only the slot area is provided with a coating. This type of a slot can be made with high directional precision up to a slot width of 0.4 mm by means of a commercially available front-milling tool. By means of the coating, the desired smaller slot widths are then created. In a further development, it is provided that the slot has a U-shaped cross-section, and that the depth of the slot is larger than its width. As a result, it is possible to produce the blow duct with a sufficiently large cross-section for the blowing-out of a sufficient air volume while, on the other hand, the dimension of the blow duct in the direction toward the center of the yarn duct can be kept small.

Other objects, advantages and novel features of the present invention will become apparent from the following detailed description of the invention when considered in conjunction with the accompanying drawings.

DETAILED DESCRIPTION OF THE DRAWINGS

Figure 1:
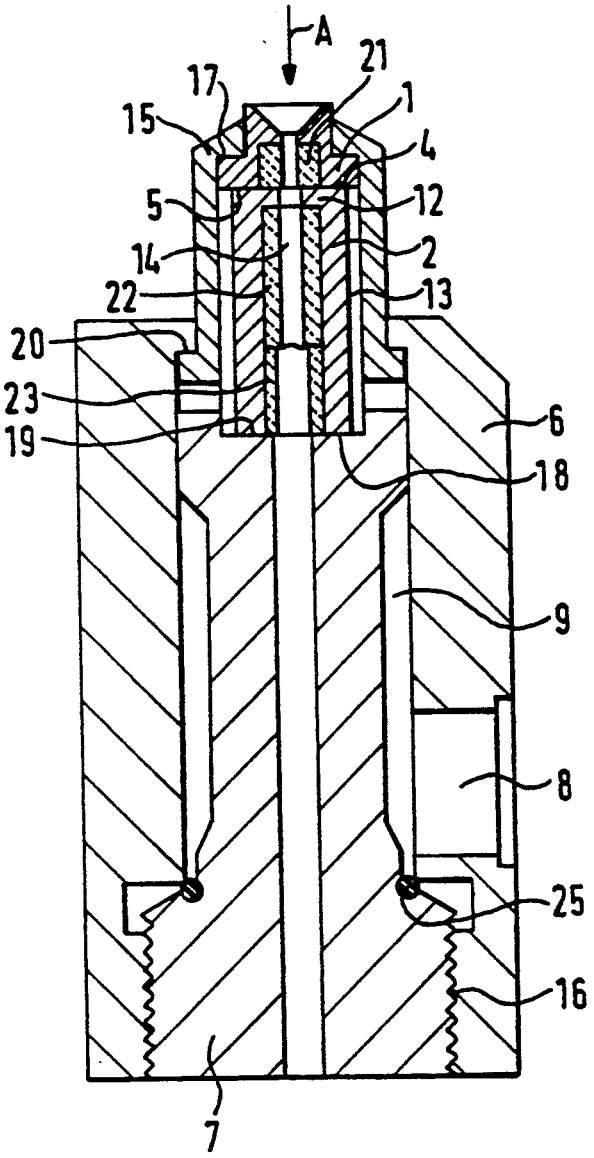
FIG. 1 is a schematic longitudinal sectional view of a false-twisting nozzle with a pertaining support housing, constructed according to a preferred embodiment of the invention.

The false-twisting nozzle shown in FIG. 1 is used for pneumatic false-twist spinning. In the travelling direction (A) of the yarn, a sliver drafted to the desirable size by a drafting unit enters into the false-twisting nozzle, is withdrawn by means of a withdrawal device, which follows, and subsequently is wound onto a spool package. The false-twisting nozzle applies a false twist to the drafted sliver, this false twist extending back to the drafting unit. Behind the false-twisting nozzle, the false twist opens up again, fiber ends, however, remaining wound around the yarn core which determine the strength of the yarn.

The false-twisting nozzle of FIG. 1 has a support housing 6 in which the actual false-twisting nozzle is held. This false-twisting nozzle has a nozzle body which is composed of two segments 1 and 2. The two segments 1 and 2 are held in a nozzle housing 15 which, in turn, is held in the support housing 6. By means of a ring collar 17, segment 1 rests against a ring shoulder of the nozzle housing. Furthermore, segment 2 is inserted into the nozzle housing 15 and, for reasons that will be explained in the following, is provided with longitudinal slots 13 at the outer circumference. By means of a ring collar 20, the nozzle housing 15 supports itself on a ring shoulder of the support housing 6. A tension insert 7 is screwed into the support housing 6 and, by means of a front surface 19, presses against a front surface 18 of segment 2 of the nozzle body and presses this segment 2 by means of a front surface 4 against a front surface 5 of segment 1 and finally presses this segment 1 by means of the ring collar 17 against the ring shoulder of the nozzle housing 15. In this case, the ring collar 20 is also braced against the ring shoulder of the support housing 6. The tension piece 7 is provided with a ring seal 25, particularly an O-ring which, when the tensioned connection is established, places itself against a sealing edge of the support housing 6.

The support housing 6 is provided with a compressed-air connection 8 which leads to an annular chamber 9 which is provided between the support housing 6 and the tension piece 7. Connections which are not shown, such as longitudinal slots of the tension piece 7, lead from this annular chamber 9 to the area of the longitudinal slots 13 of segment 2 of the nozzle body. From these longitudinal slots 13, in a manner that will be explained in the following, blow ducts 11 lead to a section 12 of the yarn duct 14 which extends in the longitudinal direction of the false-twisting nozzle. The first segment 1 of the nozzle body is provided with an insert 21 which preferably is made of a ceramic material and which forms a first section of the yarn duct 14 which has the smallest diameter. Section 12 formed by segment 2 connects to the first section. Behind this section 12, which has only a relatively short axial dimension, an insert 22 is arranged in segment 12 which also consists of a ceramic material and which has the same inside diameter as section 12. This insert 22 is followed by another insert 23 which is also made of a ceramic material and which has an inside diameter which is widened again. This insert is followed by a passage bore of the tension piece 7 as an extension of the yarn duct 14.

The blow ducts 11 are arranged between segment 1 and segment 2. They consist of slots 11 machined into segment 2 which are each staggered by 90° and which are directed tangentially with respect to section 12 of yarn duct 14. These U-shaped slots 11 are covered by segment and are thus completed to form the blow ducts.

The slots 11 which are worked into the front surfaces 4 of segment 2 are preferably worked in by means of a milling tool, such as an end-milling cutter. They have a U-shaped cross-section, as illustrated particularly in FIG. 3. The width (B) of these slots is smaller than the depth (H). The slots 11 extend in such a manner that a lateral wall of the slots 11 is aligned in an exactly tangential manner with respect to the cylindrical section 12 of the yarn duct 14 so that the mouths 10 lead largely tangentially into section 12.

The slots 11 are first made with a width which can be produced by means of a commercially available milling tool; i.e., a slot width of 0.4 mm can be achieved. Subsequently, the area of the slots 11 and the area of section 12 is provided with a coating 24, particularly with a chemically precipitated nickel layer. In order to obtain, particularly in the area of section 12, a surface that is advantageous to the fibers and at the same time is resistant to wear, diamond particles may be embedded in this nickel layer. These may be precipitated together with the nickel layer in a chemical bath. The coating 24 is deposited on the slots 11, the mouths 10 and section 12 true to their shapes so that a reduction of the width (B) of the slots to values of 0.2 mm is easily possible.

Figure 3:
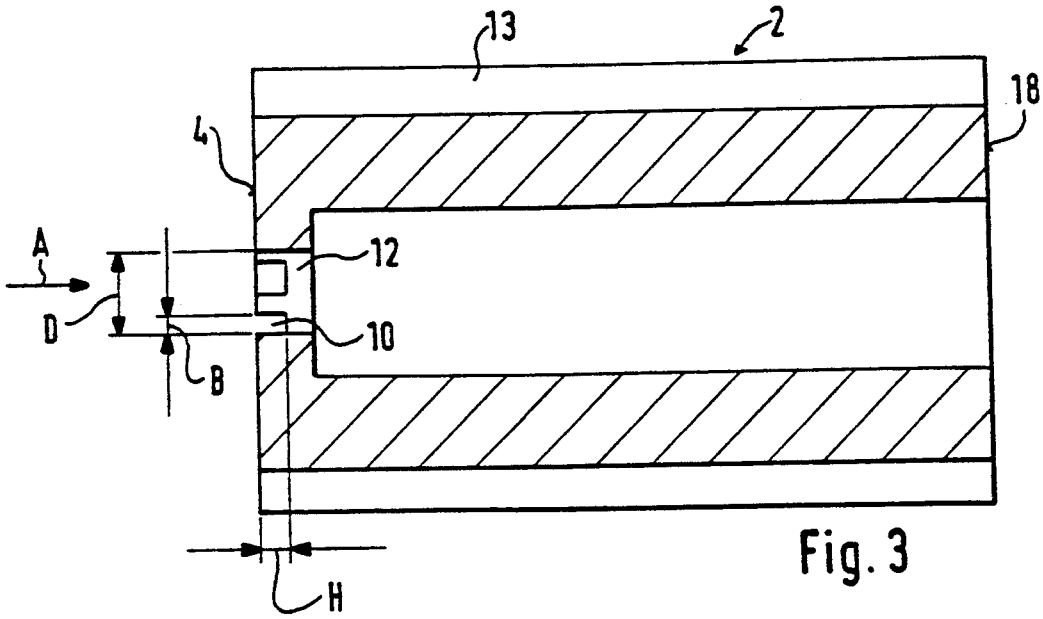
FIG. 3 is a longitudinal sectional view of the segment according to FIG. 2 along Line III-III.
Figure 2:
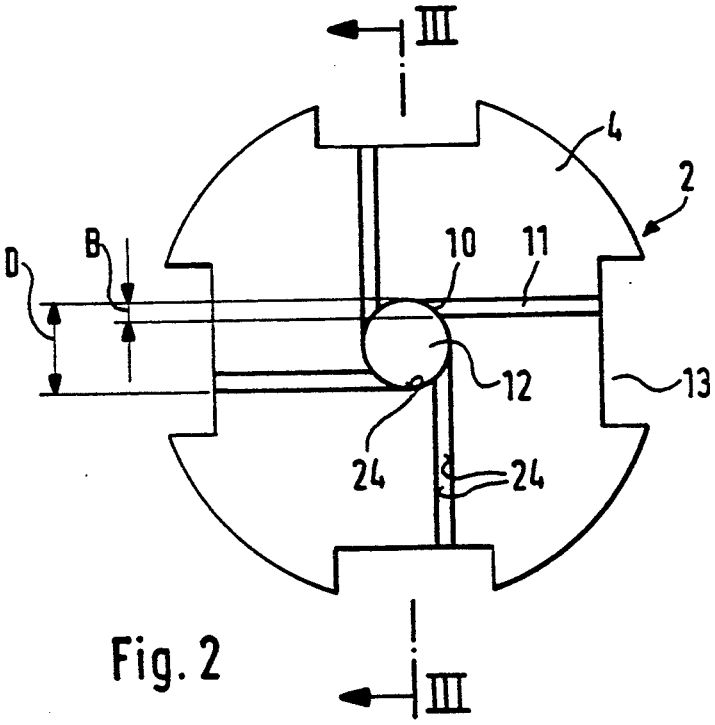
FIG. 2 is an axial view in the travelling direction of the yarn of a segment of a nozzle body of the false-twisting nozzle, constructed according to the present invention.

As shown in FIG. 3, the depth (H) of the slots is clearly larger than their width (B) so that, by way of a sufficient depth, a cross-section can be achieved in the area of the blow ducts formed by the slots 11 which, despite the small width, permits a sufficiently large air throughput.

During the preparation of the slots 11, the milling tool used for this purpose and/or the segment 2 may be guided such that the same milling tool can also produce the cylindrical section 12. In this case, segment 2 has to be chucked only once which also ensures a high precision with respect to the direction of the blow ducts and their position with respect to section 12.

In an embodiment which is not shown, the blow ducts are worked into a nozzle body in the shape of cylindrical bores in such a manner that they extend tangentially with respect to the yarn duct. In this case also, the bores are drilled with a diameter which at first is larger than the finally required diameter. The final cross-section will be produced subsequently by the application of a coating which is precipitated in the bores at least in the mouth area and in the section in which the mouths are situated.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A false-twisting nozzle for pneumatic false-twist spinning comprising:

a nozzle body formed of at least one segment, a yarn duct extending through the nozzle body, at least one blow duct leading in a tangential manner into the yarn duct, and blow duct size control means for controlling the cross-section of the blow duct outlet opening, wherein said blow duct size control means includes a coating on at least a portion of an interior wall of the at least one blow duct for the reduction of the cross-section of its outlet opening to the yarn duct, whereby the cross-section of the blow duct outlet opening is precisely controlled by said coating.

2. A false-twisting nozzle according to claim 1, wherein nickel is used as the coating which is chemically precipitated on the interior wall of the blow duct.

3. A false-twisting nozzle according to claim 1, wherein the at least one blow duct leads into a section of the yarn duct which is also provided with the coating.

4. A false-twisting nozzle according to claim 3, wherein nickel is used as the coating which is chemically precipitated on the interior wall of the blow duct.

5. A false-twisting nozzle according to claim 4, wherein the nozzle body is formed of at least two segments, wherein the at least one blow duct is machine in between two abutting segments of the nozzle body, and wherein, for the construction of a blow duct, one of the segments is provided with a slot that is open in the direction of the other segment, only the slot area being provided with a coating.

6. A false-twisting nozzle according to claim 5, wherein the at least one slot has a U-shaped cross-section, and wherein the depth of the slot is larger than its width.

7. A false-twisting nozzle according to claim 6, wherein the segment covering the at least one slot is provided with a wear-resistant insert that is made of a ceramic material and has a smaller inside diameter than a section having the blow duct opening of the at least one blow duct.

8. A false-twisting nozzle according to claim 4, wherein the segment of the nozzle body containing the section having a respective blow duct opening of each of the at least one blow ducts, in a yarn travelling direction behind this section, is provided with an insert made of a wear-proof material, preferably a ceramic material, which insert has the same inside diameter as the preceding section.

9. A false-twisting nozzle according to claim 8, wherein the insert extends only over a part of the length of one of the at least one segments of the nozzle body and is continued by a second insert which has an enlarged inside diameter.

10. A false-twisting nozzle according to claim 1, wherein the nozzle body is formed of at least two segments, wherein the at least one blow duct is machined in between two abutting segments of the nozzle body, and wherein, for the construction of a blow duct, one of the segments is provided with a slot that is open in the direction of the other segment, only the slot area being provided with a coating.

11. A false-twisting nozzle according to claim 10, wherein the at least one slot has a U-shaped cross-section, and wherein the depth of the slot is larger than its width.

12. A false-twisting nozzle according to claim 11, wherein the segment covering the at least one slot is provided with a wear-resistant insert that is made of a ceramic material and has a smaller inside diameter than a section having the blow duct opening of the at least one blow duct.

13. A false-twisting nozzle according to claim 10, where the segment covering the at least one slot is provided with a wear-resistant insert that is made of a ceramic material and has a smaller inside diameter than a section having the blow duct opening of the at least one blow duct.

14. A false-twisting nozzle according to claim 10, wherein the segment of the nozzle body containing the section having the blow duct opening of each of the at least one blow ducts, in a yarn travelling direction behind this section, is provided with an insert made of a wear-proof material, preferably a ceramic material, which insert has the same inside diameter as the preceding section.

15. A false-twisting nozzle according to claim 14, wherein the insert extends only over a part of the length of one of the segments of the nozzle body and is continued by a second insert which has an enlarged inside diameter.

16. A false-twisting nozzle according to claim 1, wherein a plurality of blow ducts are provided which lead in a tangential manner into the yarn duct, each of said blow ducts being provided on its interior walls with the coating for the reduction of the cross-section of its outlet opening to the yarn duct.

17. A false-twisting nozzle according to claim 16, wherein the nozzle body is formed of at least two axially adjacent segments, wherein the blow ducts are machined in between two abutting segments of the nozzle body by providing one of the segments with a slot that is open in the direction of the other segment, and wherein only the slot area interior walls are provided with the coating.

18. A false-twisting nozzle according to claim 17, wherein the slots each have a U-shaped cross-section and the depth of each slot is larger than its width.

19. A false-twisting nozzle according to claim 18, wherein the segment covering the slots is provided with a wear-resistant insert that is made of a ceramic material and has a smaller inside diameter aligned with the yarn duct than a following section having the blow duct openings.

20. A false-twisting nozzle according to claim 17, wherein the segment covering the slots is provided with a wear-resistant insert that is made of a ceramic material and has a smaller inside diameter aligned with the yarn duct than a following section having the blow duct openings.

21. A false-twisting nozzle according to claim 17, wherein said coating is chemically precipitated on the interior walls of the blow ducts.

22. A false-twisting nozzle according to claim 1, wherein nickel is used as the coating which is chemically precipitated on the interior walls of the blow ducts.

23. A false-twisting nozzle according to claim 1, wherein said coating is chemically precipitated on the interior walls of the blow ducts.

* * * * *